United States Patent [19]

King

[11] Patent Number: 5,065,936

[45] Date of Patent: Nov. 19, 1991

[54] COLLAPSIBLE BOX FOR TISSUES/PAPERS

[76] Inventor: Charles S. King, 19842 Edgwood La., Huntington Beach, Calif. 92646

[21] Appl. No.: 360,022

[22] Filed: Jun. 1, 1989

[51] Int. Cl.[5] ..... B65D 5/16

[52] U.S. Cl. ..... 229/101; 206/494; 221/65; 229/104

[58] Field of Search ..... 229/101, 104, DIG. 3; 206/494, 45.16; 221/37, 45, 65, 305

[56] References Cited

U.S. PATENT DOCUMENTS

| | | | |
|---|---|---|---|
| 1,941,843 | 1/1934 | Kulpinski | 229/104 |
| 1,973,633 | 9/1934 | Kulpinski | 229/104 |
| 3,172,563 | 3/1965 | Harwood | 206/494 |
| 3,249,283 | 5/1966 | Craddock et al. | 229/101 |
| 3,258,156 | 6/1966 | Smith | 206/494 |
| 3,279,593 | 10/1966 | Cote | 206/817 |
| 3,349,959 | 10/1967 | Watkins | 221/65 |
| 3,727,827 | 4/1973 | Stice | 229/DIG. 3 |
| 4,238,068 | 12/1980 | Ellerbe et al. | 229/101 |

*Primary Examiner*—Stephen P. Garbe

[57] ABSTRACT

An oblong shaped box for tissues or papers with an opening (21) on top through which tissues or papers are removed one at a time. Moving the bottom up is made possible by folding in the lower sections of the four sides along punctured fold lines (30), and crushing in the corners along lines (40, 60). Lines (50) near but inside the borders of the bottom create the needed space to allow the bottom to move up.

1 Claim, 3 Drawing Sheets

COLLAPSIBLE BOX FOR TISSUES/PAPERS

FIELD OF THE INVENTION

This invention relates to tissue boxes with an opening on the top from which tissues can be removed one at a time.

DISCUSSION OF PRIOR ART

The conventional and existing tissue boxes (FIG. 1) with an opening on the top from which tissues (folded into the box) can be removed one at a time have been on the market for many years. However, the design of the box has remained essentially the same throughout the years, and no significant improvement in the design has been made to address a common drawback of the box, i.e. the difficulty in removing the tissues near the bottom of the box when the level of tissues becomes low. Although removing tissues from such conventional boxes is easy when the box is full, removing them from most conventional boxes inevitably becomes difficult and cumbersome when the level of tissues in the box is low. This is because the greater distance between the opening and the tissues makes it more difficult for a fresh tissue to remain outside the opening for removal even after it has been pulled partially out by a previous tissue. More often than not, a fresh tissue would slip back and remain entirely inside the box. The users would then have to dig into the box in order to take a tissue out. To do so is difficult, cumbersome, inconvenient and annoying and the box is often worn and torn around the opening thus giving the box an untidy and unbecoming appearance.

The box of this invention is designed to eliminate the conventional boxes' inherent problems. The objective of this invention is easy removal of tissues from the box to the last even when the level of tissues becomes low. This is achieved by crushing in the four bottom corners and folding in the lower sections of the four sides when about half of the tissues is used up, thus raising the bottom and moving the remaining tissues closer to the opening. In so doing, a new box about half its original height or thickness is created. As the tissues are moved closer to the opening, a fresh tissue would more than likely remain partially outside the opening after it is pulled by a previous tissue for easy removal. Therefore, the difficulty of removing tissues near the bottom of the conventional box is eliminated in one simple manual operation by collapsing the box, —the main characteristic of this invention.

To the inventor's best knowledge, there is no prior art directly germane to this invention in design.

OBJECTS AND ADVANTAGES

Ease of removing all the tissues from the box is the primary advantage of this invention, and collapsibility its main feature. The working principle of this invention is demonstrated in this sequence: (1) the bottom is raised by collapsing or crushing in the four bottom corners, and pushing in the foldable lower sections of the four sides, (2) the tissues are pushed up closer to the opening, (3) part of a fresh tissue would more likely remain outside the opening after it is pulled by a previous tissue, and (4) a fresh tissue is readily available for easy removal. The bottom, once pushed up, would be held at the new position firmly and securely by the inward pulling tension of the four sides.

As the users don't have to dig into the box for a tissue, the chance of wear and tear around the opening would be reduced. Therefore, this box is more likely to remain tidy to the end.

The manual operation of collapsing the box is simple and easy; therefore, it can be done by persons of almost any age.

DESCRIPTION—FIGS. 1 to 5

Figure 1:
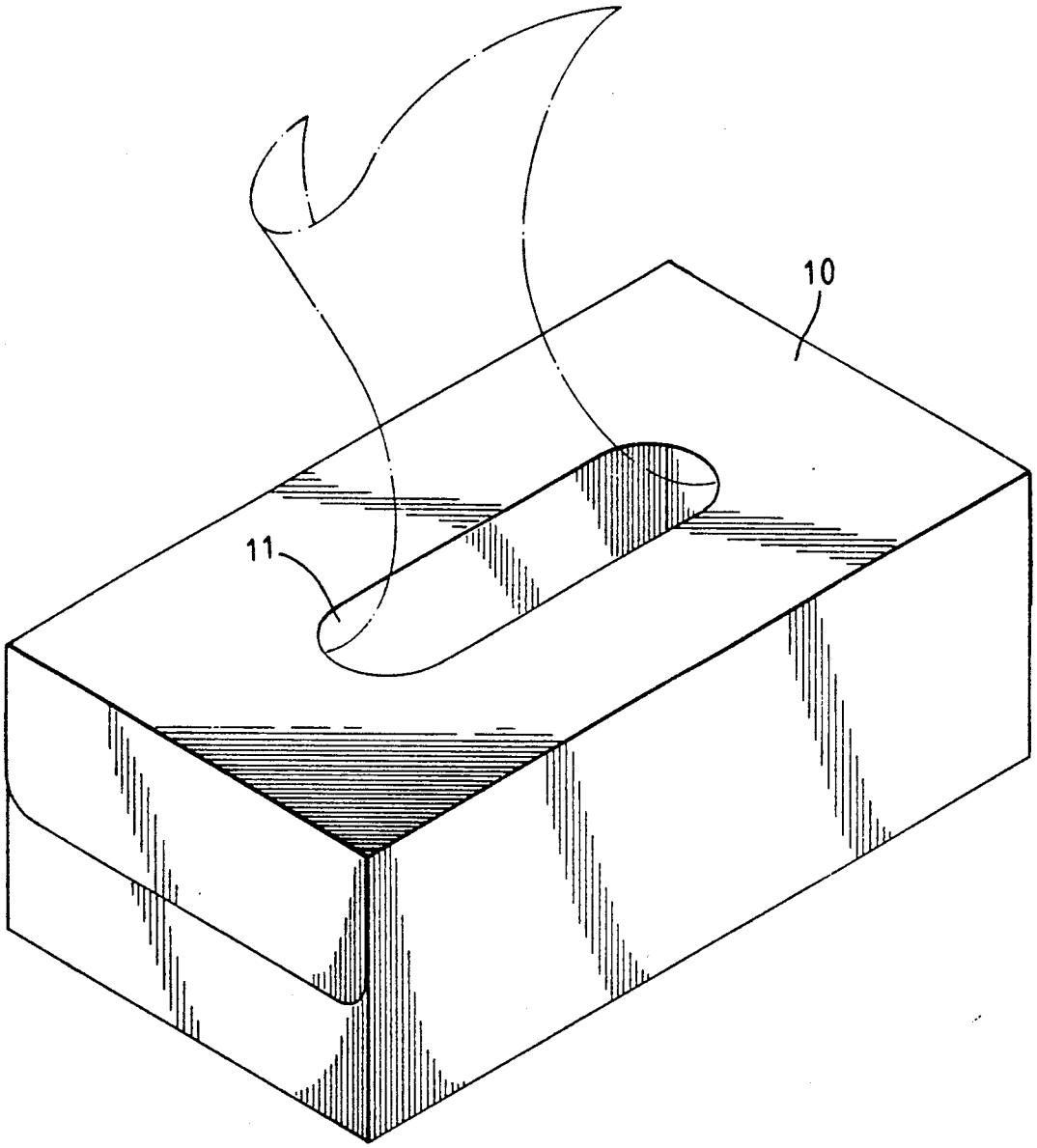
FIG. 1 PRIOR ART
FIG. 1—view of conventional tissue box

FIG. 1 shows a conventional tissue box, oblong in shape, with an opening (11) on the top (10) through which tissues are removed. The tissues are folded into the box for removal one at a time.

Figure 2:
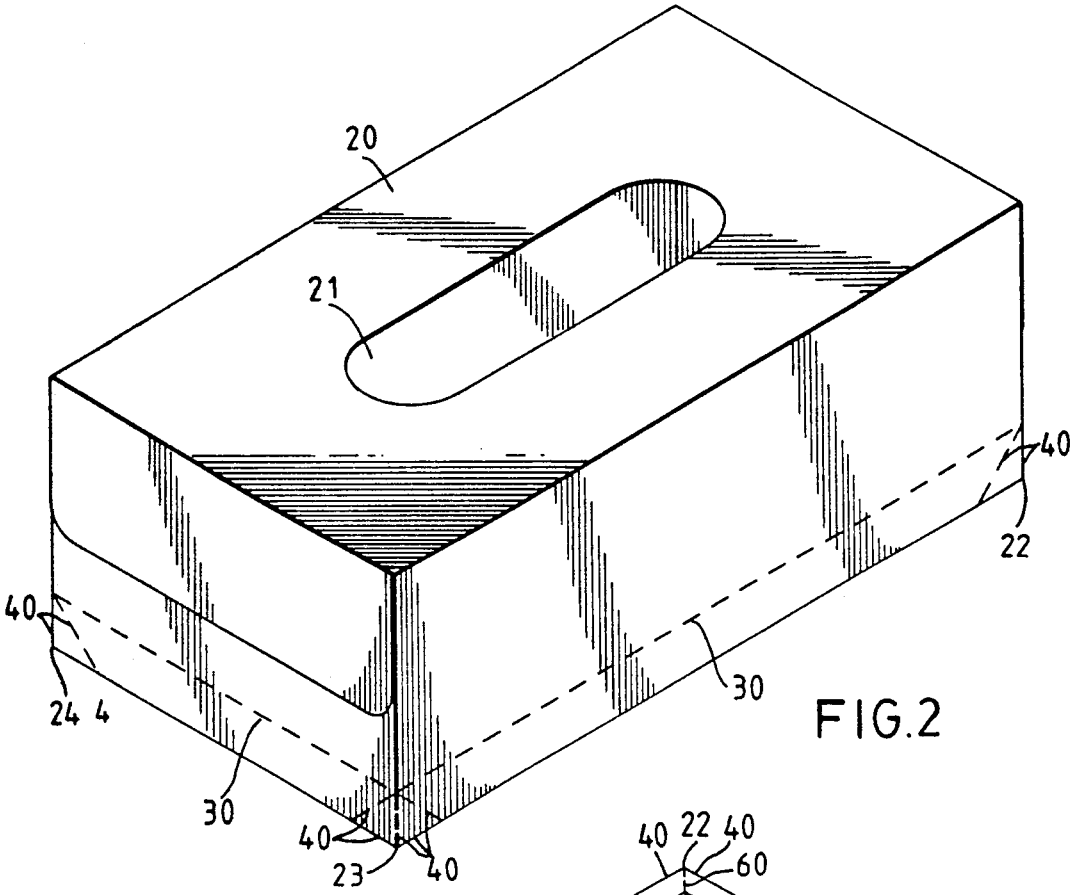
FIG. 2—view of invention box in upright position

FIG. 2 shows a box of this invention similar to FIG. 1 conventional box in basic construction. FIG. 2 box also has an opening (21) on the top through which tissues are removed one at a time. Punctured fold lines (30) in the lower sections of the four sides, and similar lines (40) around bottom corners (22, 23, 24, 25) would help push the bottom up.

Figure 3:
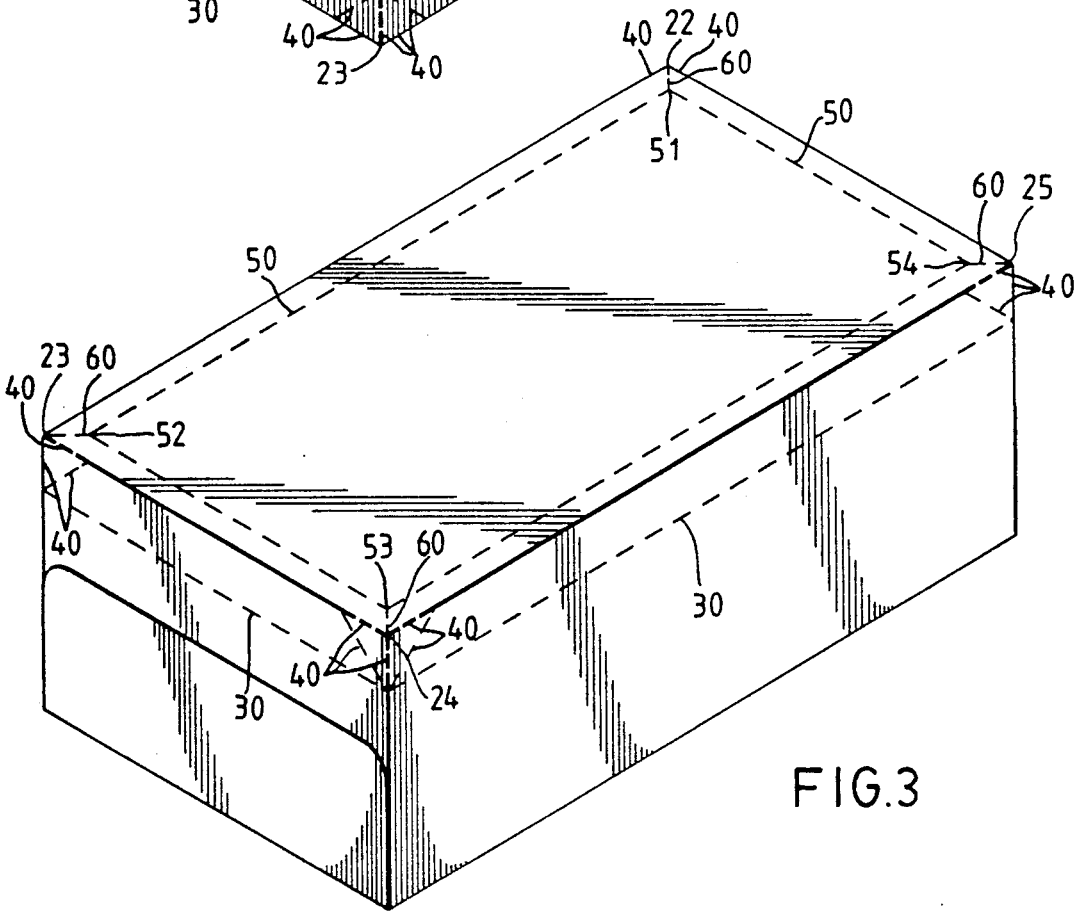
FIG. 3—view of invention box upside down before collapsing

FIG. 3 is a view of the invention box upside down showing more punctured fold lines. Lines (50) along but inside the border lines of the bottom would help reduce the size of the bottom. Lines (40) around corners (22, 23, 24, 25) would help crush in these corners. Connecting lines (60) between corners (51, 52, 53, 54) and corners (22, 23, 24, 25) also would help crush in corners (51, 52, 53, 54).

Figure 4:
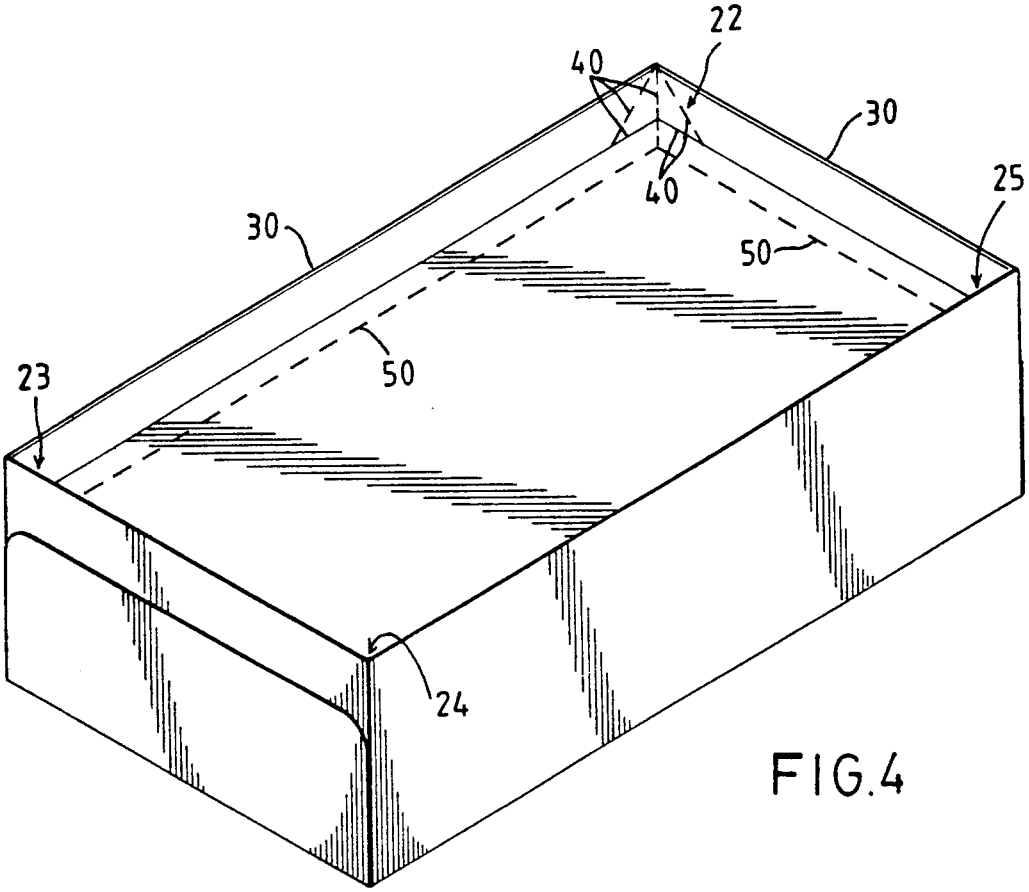
FIG. 4—view of invention box upside down after collapsing

FIG. 4 shows box upside down after it is collapsed with the bottom pushed down along fold lines (30), and the four corners (22, 23, 24, 25) in reverse direction after being crushed in and pushed inside out.

Figure 5:
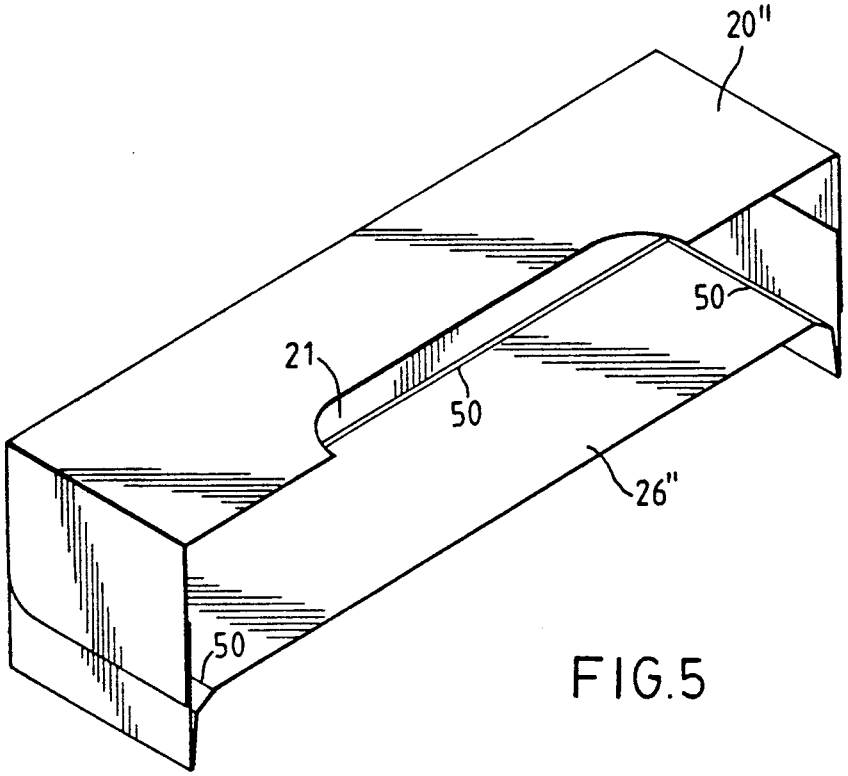
FIG. 5—sectional view of invention box in upright position after collapsing

FIG. 5 is a sectional view of the collapsed box in upright position with the raised bottom (26) at a new position.

OPERATION—FIGS. 1 to 5

The manner of removing tissues from the invention box is identical to that from FIG. 1 conventional boxes because of the similarity in basic construction. However, as shown in FIGS. 2 to 5, the invention box is designed to collapse so as to reduce its height or thickness to ensure easy removal of all the tissues from the box. The many punctured fold lines are designed for easy folding and crushing in cf certain parts of the box. Each line has a special function that makes collapsing the box possible.

Punctured fold lines (30) on the four sides would allow sections below the lines to fold inward. Once folded in, these folded-in sections would push the bottom up and hold it at the new position firmly and securely.

Lines (40) outlining the shape of "pyramids" around corners (22, 23, 24, 25) would make crushing in of these corners possible. These corners, after being pushed in along lines (40) and anchored in reverse direction as shown in FIG. 4, would help hold up the bottom at its new position.

Lines (50) along but inside the border lines of the bottom would reduce the size of the bottom. The reduction is necessary for creating the needed space to allow the bottom to be pushed down.

Lines (60) have similar function as lines (40) in that they are indispensable for the crushing in of corners (22, 23, 24, 25). They are the links between corners (22, 23, 24, 25) and the corners (51, 52, 53, 54). Together with lines (40), they (60) allow the corners (22, 23, 24, 25) to be crushed in or pushed inside out, —an essential part in the operation of collapsing the box.

The sectional view of the box after collapsing shows how the raised bottom (26) is held at its new position. The inward pulling tension of the four sides, along with the securely anchored corners (22, 23, 24, 25), all contribute to the firm positioning of the bottom at its new position.

To collapse the box, one would turn the box upside down, and simply push down on the corners (22, 23, 24, 25), two at a time, with thumbs. A preferable way would be pushing down on corners (23, 24) together with thumbs gently and firmly. With the pushing down of these two corners, about one half of the length of the bottom, where corners (22, 24) are at, would also have been pushed down. After this end is pushed down, repeat the same by pushing down on corners (22, 25). The entire bottom would then have been pushed down. An alternate way would be pushing down on corners (22, 23) together first, then repeat the same by pushing down on corners (24, 25) together. (Pushing the bottom and corners down when the box is upside down is, in reality, pushing them up with the box rightside up.)

The operation of collapsing the box is now completed. To sum up, the operation of collapsing the box consists of three simple steps: (1) turn the box upside down, (2) push down on two corners on one end together, and (3) repeat the same on the two other corners. One needs now only to turn the box rightside up. The remaining tissues in the box would have filled to the top and one can continue to use the box as if it were a fresh one.

REFERENCE NUMBERALS IN DRAWINGS

10 top of a conventional box
11 opening of a conventional box
20 top of invention box
21 opening
22, 23, 24, 25 corners bordered by punctured fold lines (40)
26 raised bottom of invention box
30 punctured fold lines on lower sections of four sides
40 punctured fold lines around corners (22, 23, 24, 25)
50 punctured fold lines along but inside border lines of bottom
51, 52, 53, 54 corners formed by punctured fold lines (50)
60 punctured fold lines connecting corners (22, 23, 24, 25) and corners (51, 52, 53, 54)

CONCLUSION

Thus the reader will see that the collapsible box of this invention provides a highly efficient, yet easy-to-apply structure for easy removal of the tissues to the last, and that the act of collapsing the box can be easily done by persons of almost any age.

While the above description contains many specifities, these should not be construed as limitations on the scope of the invention, but rather as an exemplification of one preferred embodiment thereof. Many other variations are possible. For example, the box maybe used to contain facial tissues or any other types of tissues or papers folded into it for removal one at a time. The advantage of this invention is especially evident when applied to extra large boxes holding tissues, napkins or papers larger in size or number, or both. Additionally, to assist the users, a tissue of different color or one bearing a special message could be inserted among the tissues at the appropriate juncture to advise the users to collapse the box. Although started out as a larger box holding 200 2-ply tissues or more, it is reduced to a smaller box about half its original height or thickness after being collapsed. As a re-created smaller box, it has the advantage and convenience it did not have while in its original shape. In essence, this invention offers the holding capacity of a larger box and the convenience of a smaller box.

I claim:

1. A variable size cardboard box having a top wall, a bottom wall, and four side walls, each wall having four edges, said top wall having an opening for accessing the interior, a continuous perforated line located in the side walls and extending around the entire perimeter of the box and spaced from the bottom wall, three auxiliary perforated lines of equal length located at each of the four bottom corners of the box and extending along the edges of respective side walls and the bottom wall, all of said perforated lines providing means which facilitate pushing the bottom wall into the box to reduce its interior volume, the bottom wall including a rectangular, auxiliary perforated line spaced a short distance form and parallel to, the edges of the bottom wall, the bottom wall further including four additional perforated lines which connect the corners of the bottom wall to the corners of the auxiliary line to facilitate forming a smaller bottom wall when it is inside the box.

* * * * *